US005161260A

United States Patent [19]

Reynolds

[11] Patent Number: 5,161,260

[45] Date of Patent: Nov. 10, 1992

[54] ATHLETIC HEADWEAR

[76] Inventor: Jeff Reynolds, 9967 Camp Rd., Mt. Vernon, Ohio 43050

[21] Appl. No.: 746,407

[22] Filed: Aug. 16, 1991

[51] Int. Cl.[5] ..... A42B 5/00

[52] U.S. Cl. ..... 2/207; 2/171; 2/174; 2/195

[58] Field of Search ..... 2/171, 171.4, 171.5, 2/171.6, 171.7, 171.8, 174, 175, 181, 183, 195, 197, 198, 202, 204, 207, 410, 417, 418, 420

[56] References Cited

U.S. PATENT DOCUMENTS

| | | | |
|---|---|---|---|
| 781,232 | 1/1905 | Saks | 2/207 |
| 1,819,558 | 8/1931 | Husman | 2/174 |
| 2,005,361 | 6/1935 | Rollins | 2/198 |
| 2,112,774 | 3/1938 | Thorman | 2/207 |
| 2,124,431 | 7/1938 | Praytor | 2/174 |
| 2,519,512 | 8/1950 | Stone | 2/174 |
| 2,574,208 | 11/1951 | Crowthers | 2/207 |
| 2,988,748 | 6/1961 | Rollins-Dudley | 2/198 |
| 3,555,565 | 1/1971 | Zimmon | 2/207 |
| 3,671,977 | 6/1972 | Degnon | 2/207 |
| 5,016,287 | 5/1991 | Harris | 2/202 |
| 5,048,128 | 9/1991 | Watson | 2/196 |
| 5,058,211 | 10/1991 | Hanks | 2/171 |
| 5,062,157 | 11/1991 | Muta | 2/171 |

FOREIGN PATENT DOCUMENTS

| | | | |
|---|---|---|---|
| 3525658 | 2/1986 | Fed. Rep. of Germany | 2/207 |
| 229872 | 3/1925 | United Kingdom | 2/207 |
| 497387 | 12/1938 | United Kingdom | 2/174 |
| 763721 | 12/1956 | United Kingdom | 2/174 |
| 827231 | 2/1960 | United Kingdom | 2/207 |

*Primary Examiner*—Werner H. Schroeder
*Assistant Examiner*—Diana L. Biefeld
*Attorney, Agent, or Firm*—Wenderoth, Lind & Ponack

[57] ABSTRACT

An athletic headwear especially suitable for sporting activities and high wind conditions. The headwear comprises a body portion adapted for covering the head and hair of a wearer, the body portion having an inner surface and an outer surface, and the body portion having a generally linear forward edge, so that the forward edge of the body portion at its median portion is adapted for positioning on the forehead of the wearer, an elastic headband integral with the forward edge of the body portion on its outer surface, the elastic headband having opposite free ends extending beyond the forward edge, and the opposite free ends having means for fastening the ends to each other, so that the ends may be fastened to each other behind the head of the wearer at the nape of the neck to secure the headwear to the wearer's head, and a sweatpad integral with the forward edge of the body portion on its inner surface.

15 Claims, 5 Drawing Sheets

ATHLETIC HEADWEAR

FIELD OF THE INVENTION

This invention relates to a novel type of headwear or head covering. Particularly, the invention relates to a head covering which is designed to fit securely on the wearer's head and to protect the wearer's hair, especially during a sporting activity.

BACKGROUND OF THE INVENTION

It is well known that bandannas, scarves, turbans, and other types of headwear have long taken many forms both in relation to the type of material used in the manufacture of the headwear and in the appearance conveyed. Many different shapes and styles of headwear are known, each having its own unique features and functions.

Moreover, headwear has been designed and used for a wide variety of practical purposes, e.g. to protect the head from sunburn, and to protect the hair from harsh weather and debris in the air. Other headwear has been designed primarily for beautifying the appearance of the wearer.

There are many types of headwear or head coverings used or designed primarily for sporting activities. Aside from protective helmets, one of the most common types of head coverings is a cap. Among these, the so-called baseball cap is popular. Another type of headwear used in some sporting activities, such as tennis and soccer, is a sweatband.

Among the known types of fabric head coverings which are adapted to fit closely to the wearer's head and to cover the hair, one of the simplest is a "Doo Rag". This head covering is essentially a plain piece of fabric, generally in the shape of a square, which is adapted to fit the wearer's head by simply knotting it at the corners so as to fit it to the head of the wearer and to cover the hair.

Another head covering which is generally similar in shape to one embodiment of the present invention is a head covering known as a "LOOKING GOOD WAVE CAP". This head covering is usually used in conjunction with a chemical hair treatment, such as used by Afro-Americans, and is constructed of a single piece of synthetic fabric cut in a generally rectangular configuration. The fabric is cut in a way that two narrow strips of fabric extend off the forward edge of the head covering. These fabric strips are used to secure the head covering to the wearer's head by tying the two strips of fabric together behind the wearer's head near the nape of the wearer's neck over the body portion.

The following U.S. Pats. may also be of interest relative to the present invention in disclosing other types of headwear and head coverings.

| U.S. Pat. No. | Date | Inventor |
|---|---|---|
| 3,541,610 | 11/24/70 | Gettinger |
| 3,613,118 | 10/19/71 | Lucas |
| 4,031,567 | 6/28/77 | Planck |
| 4,222,125 | 9/16/80 | Sewell-Wood |
| 4,468,818 | 9/4/84 | Flannery |
| 4,599,749 | 7/15/86 | Childs |
| 4,964,175 | 10/23/90 | Taylor |

Despite the variety and number of head coverings which are known, it will be apparent from the following description of the present invention that no type of headwear in the prior art provides the advantages or construction of the athletic headwear of the present invention.

SUMMARY OF THE INVENTION

This invention relates to a novel type of headwear which is designed to fit securely on the wearer's head and to protect the wearer's hair, especially during a sporting activity.

More particularly, a primary object of the present invention is to provide a head and hair protective device which fits securely to the wearer's head and protects the wearer's hair under heavy wind conditions, such as during athletic sports activities like skiing, bicycling, motorcycling and the like, without being blown off.

Another object is to provide a head and hair covering that is easy to use and comfortable to wear.

A further object is to provide a head covering having a sweatpad fitted to the inside of the headcovering for the purpose of absorbing perspiration. The sweatband may also provide the further benefit of cushioning the forehead of the wearer from the weight of a cap or hard hat worn over the headwear.

Another object is to provide a head and hair covering which will enhance the appearance of the wearer. The headwear can be manufactured from a variety of fabric patterns to provide a pleasing variation in decoration that will appeal to a broad range of tastes. Thus, the headwear of the present invention is designed to provide a head covering that is stylish, colorful and comfortably convenient to wear, and can be manufactured out of a variety of fabrics in both solid and designs that can match or enhance a wearer's clothing, costume, etc., while remaining decorative on the head.

A further object of this invention to provide a head covering which may be worn in more than one way, so that, for example, the fabric body can be tightly rolled to create an easy to use, decorative headband.

Another object of the invention is to provide a head covering which is capable of protecting the wearer's hair from environmental conditions and debris in the air. People in the occupational areas of painting, welding, etc., or who are exposed to chemicals in the air, need head or hair coverings to prevent damage to their head or hair. Protection can be achieved by adapting the main fabric body to the environmental conditions, such as manufacturing the headwear out of leather, etc.

Aside from the foregoing objects and uses, the head wear of the present invention may also be used in the place of conventional headcoverings used in connection with a chemical hair treatments, to keep the chemical treatment on the hair or head and to protect the wearer's bedding from exposure to the chemicals during sleep.

DETAILED DESCRIPTION OF THE PREFERRED EMBODIMENTS

Figure 1:
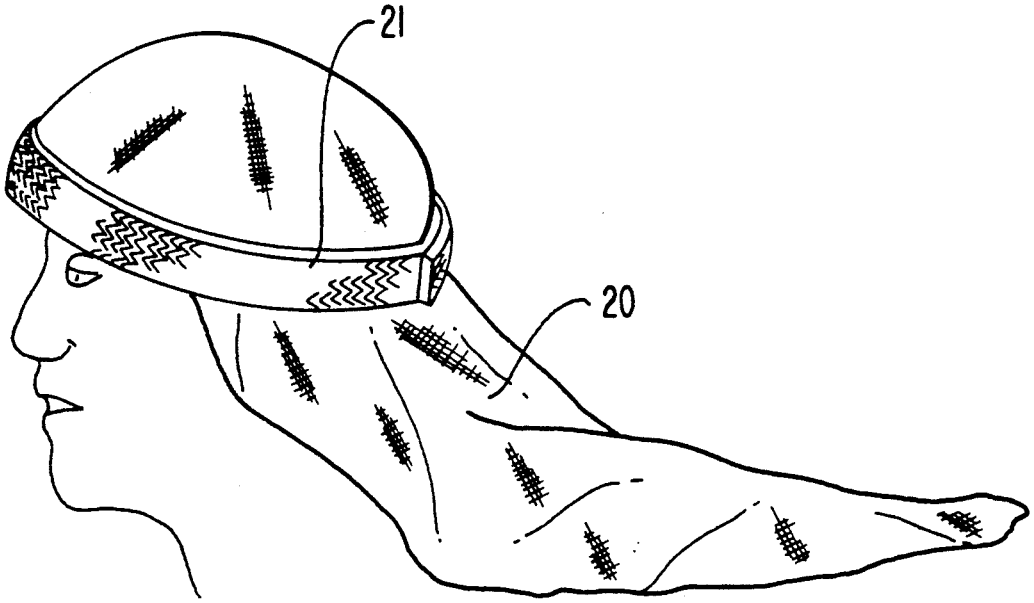
FIG. 1 is a side perspective view of a first embodiment of the athletic headwear of the present invention in use covering the head and hair of a wearer.
Figure 8:
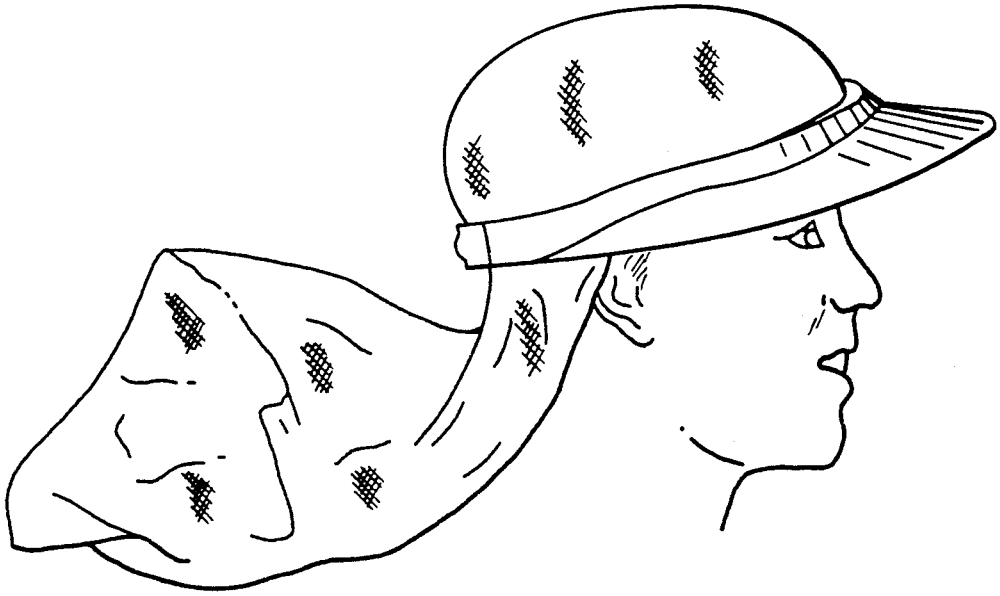
FIG. 8 is a side perspective view of the first embodiment of the athletic headwear of the present invention in use covering the hair of a wearer in combination with a visor.

The athletic headwear of the present invention essentially comprises a body portion, an integral elastic headband and an integral sweatpad.

The body portion may be configured in a variety of shapes and sizes. Particularly, a rectangular shape and a pentagonal shape are preferred shapes and are used in the specific embodiments of the invention, however other suitable shapes will be readily apparent to those skilled in the art from the present disclosure, and the present invention is not limited in any way to the shapes of the body portions of the preferred embodiments.

The body portion has a shape such that it has a generally linear forward edge. The forward edge of the body portion at its median portion is adapted for positioning on the forehead of the wearer.

The body portion may be made of any suitable material, for example a natural fiber, a synthetic fiber, leather, plastic, or combinations thereof.

The elastic headband is integral with the forward edge of the body portion on its outer surface. The elastic headband may be attached to the body portion by stitching and the like. The headband has extends beyond the forward edge and has opposite free ends. The free ends have means for fastening the ends to each other, and the headband is long enough such that these ends may be fastened to each other behind the head of the wearer at the nape of the neck to secure the headwear to the wearer's head.

The fastening means are preferably adjustable so that the headband may be conveniently and snugly fastened to any head size. A preferred adjustable fastening means is the hook and loop type fastener such as that sold under the trademark VELCRO, although any conventional type of adjustable fastening means may be used. Opposite configuration VELCRO pads are disposed at the opposite free ends of the headband so that the VELCRO pads may be secured together to snugly fasten the ends of the headband together around the wearer's head. Another preferred type of adjustable fastening means is a hook and loop type of the sort where a hook is slidably disposed near one end of the headband and a loop slidably disposed near the other end of the headband. On either side of both the hook and the loop are disposed the opposite configuration VELCRO pads. Thus, the headband is capable of adjustment by positioning the hook and/or the loop at a suitable position near their respective ends of the headband. The hook and loop may then be fixed in position by securing together the opposite configuration VELCRO pads adjacent to the hook and loop, respectively. By the use of the VELCRO pads, the position of the hook and the loop can of course be readjusted.

The sweatpad is integral with the forward edge of the body portion on its inner or under surface. The sweatpad may be secured to the forward edge by stitching and the like. The sweatpad should be made of a material capable of absorbing perspiration and may be any thickness, however if a relatively thick material is used, the sweatpad may provide the further benefit of cushioning the forehead of the wearer from the weight of a cap or hard hat worn over the headwear.

Referring now to the drawings, FIG. 1 is a side view of the headwear as it is worn on the head. This view shows the basic components of headwear, to wit, the body portion 20 and the elastic headband 21.

Figure 2:
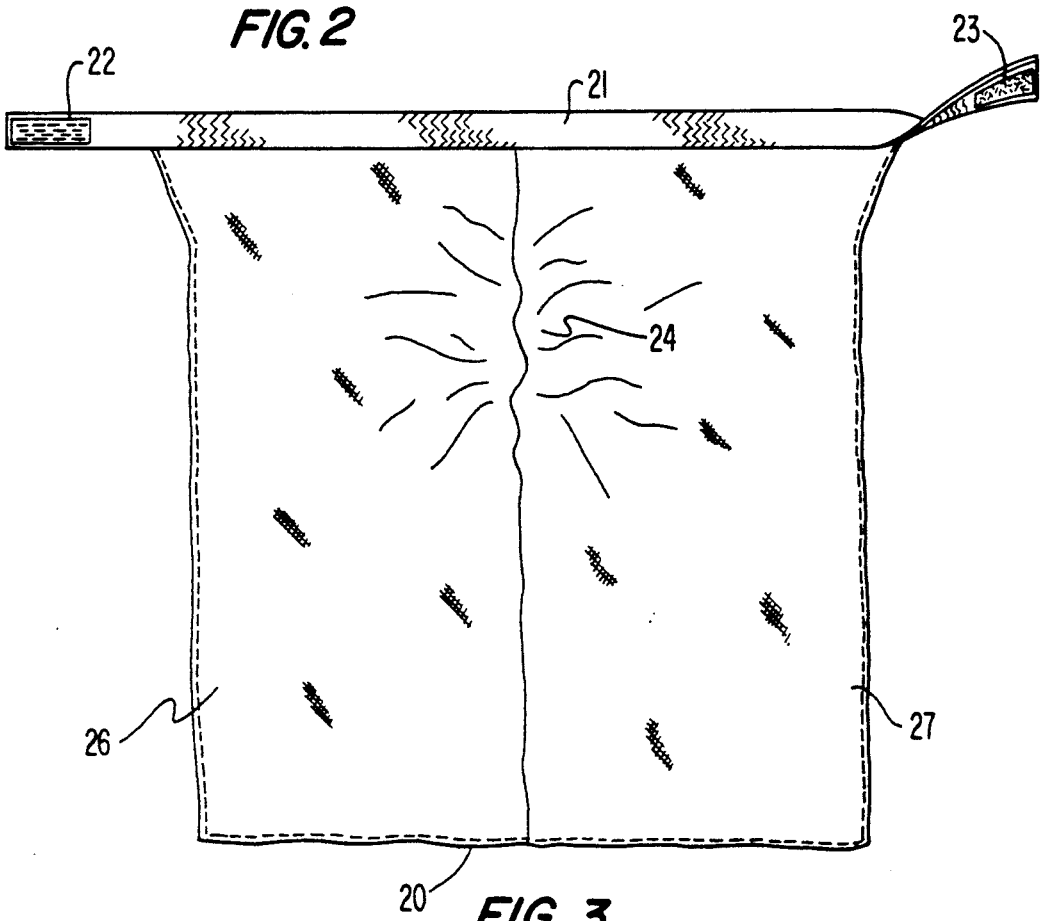
FIG. 2 is a top plan view of the first embodiment of the athletic headwear of the present invention.
Figure 9:
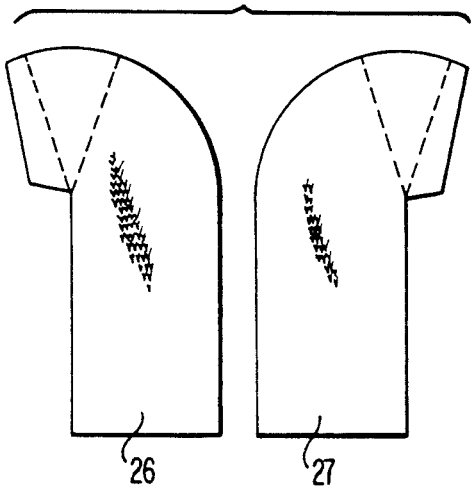
FIG. 9 is a top plan view of two panels for assembly into the first embodiment of the athletic headwear of the present invention, the headband and sweatpad not being shown.

FIG. 2 is a top view of the first embodiment of the headwear of the present invention showing its outer surface when worn. The body portion 20 is configured generally in the shape of a rectangle and is assembled from the two symmetrical panels 26,27 shown in FIG. 9. The shape of the two panels allows the forward section 24 of the body portion to fit snugly to the wearer's head when they are stitched. This embodiment is characterized by having a seam from the front to the rear of the body portion 20. The headband 21 is attached to the forward edge of the body portion 30, and opposite configuration VELCRO pads 22 and 23 are attached to the headband 21 proximate to its respective opposite free ends.

Figure 3:
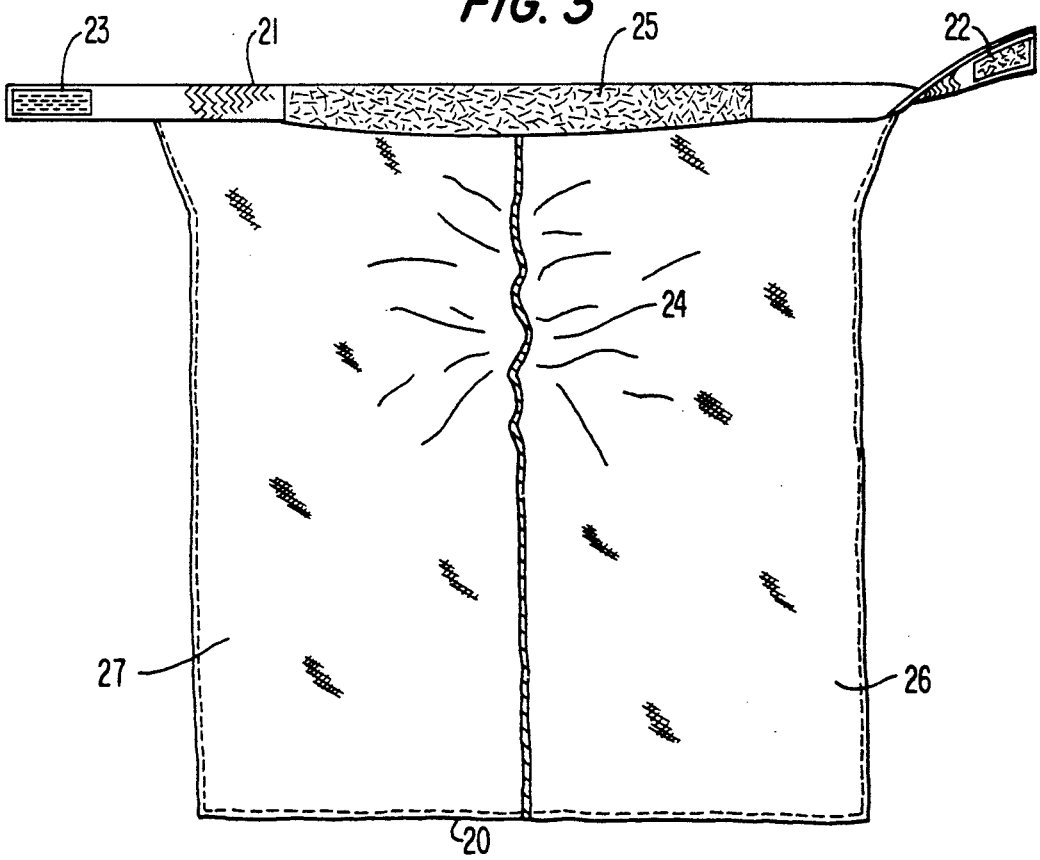
FIG. 3 is a bottom plan view thereof.

FIG. 3 is a bottom view of the first embodiment showing its inner or under surface when worn. The absorbent sweatpad 25 is attached to the forward edge of the body portion 30. The two panels are preferably stitched on this side of the body portion so that when the headwear is worn, the seam is less visible.

Figure 4:
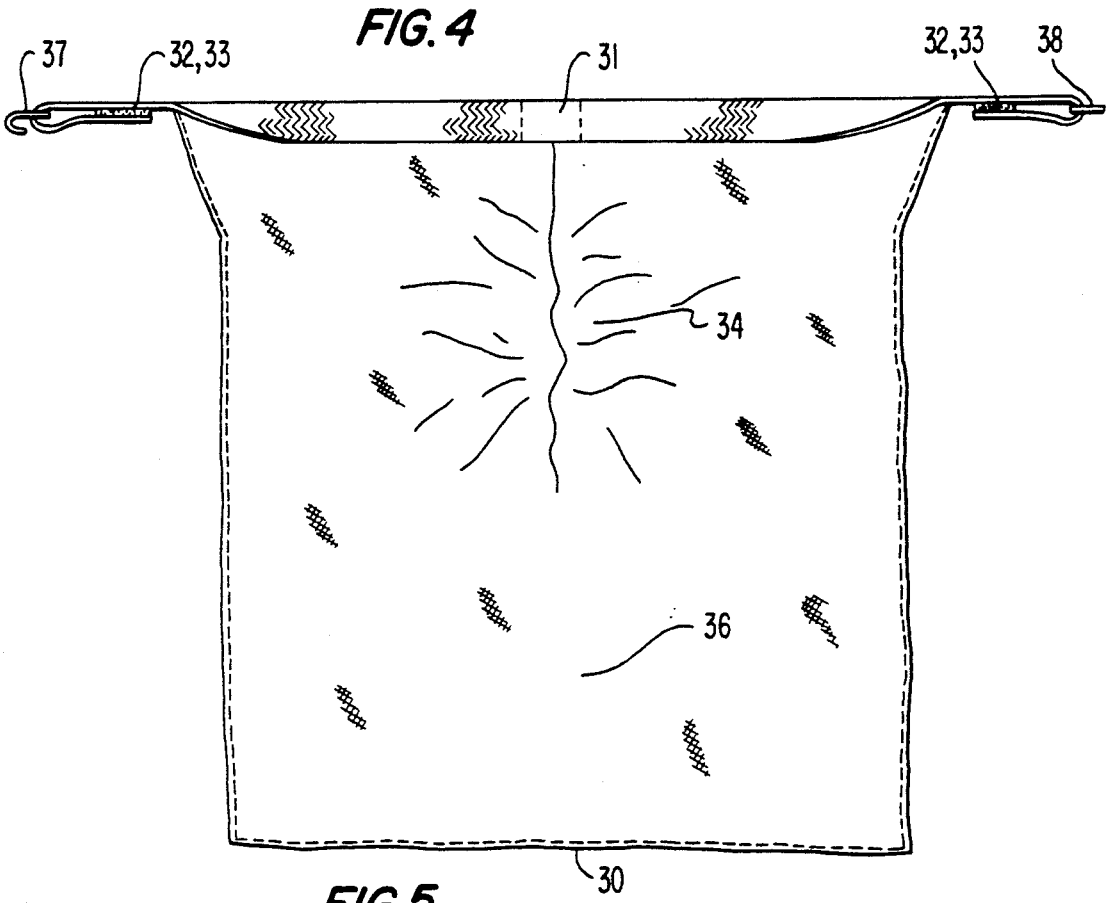
FIG. 4 is a top plan view of a second embodiment of the athletic headwear of the present invention.
Figure 10:
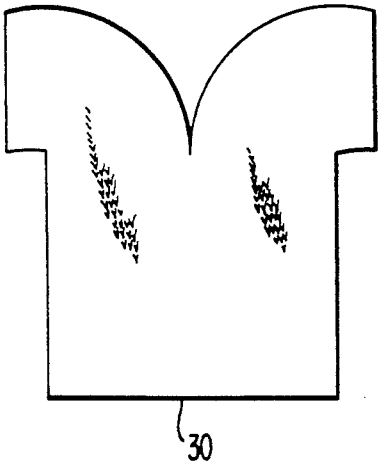
FIG. 10 is a top plan view of a single panel for assembly into the second embodiment of the athletic headwear of the present invention, the headband and sweatpad not being shown.

FIG. 4 is a top view of a second embodiment of the headwear of the present invention showing its outer surface when worn. The body portion 30 is generally configured in the shape of a rectangle and is assembled from a single panel of material shown in FIG. 10. The seam is centered on the forehead and extends from the front of the head and terminates at the back of the head. The front section 34 of the body portion 30 is cut so that it fits snugly to the wearer's head. The rear section 36 of the body portion 30, that drapes down the nape of the neck, is seamless. This pattern is advantageous with silk screening processes, so that designs, logos, promotional messages and the like can be easily printed on the back section. The headband 31 is attached to the front edge of the body portion 30. In this embodiment, VELCRO 32,33 and hook 37 and loop 38 fastening means are used.

Figure 5:
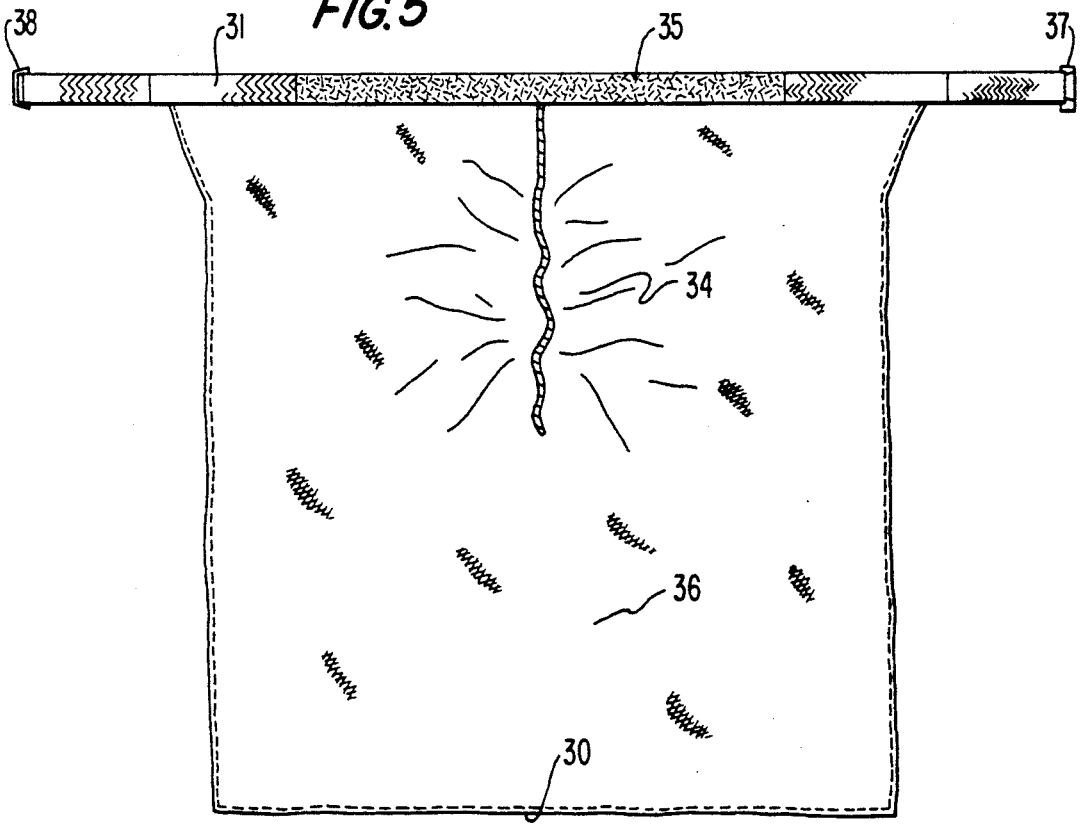
FIG. 5 is a bottom plan view thereof.

FIG. 5 is a bottom view of the second embodiment showing the inner or under surface of the headwear when worn. The sweatpad 35 is attached to the forward edge of the body portion 30. As in first embodiment shown in FIG. 3, the stitching of the forward section 34 of the body portion is preferably done on this side to make the seam less visible when the headwear is worn.

Figure 6:
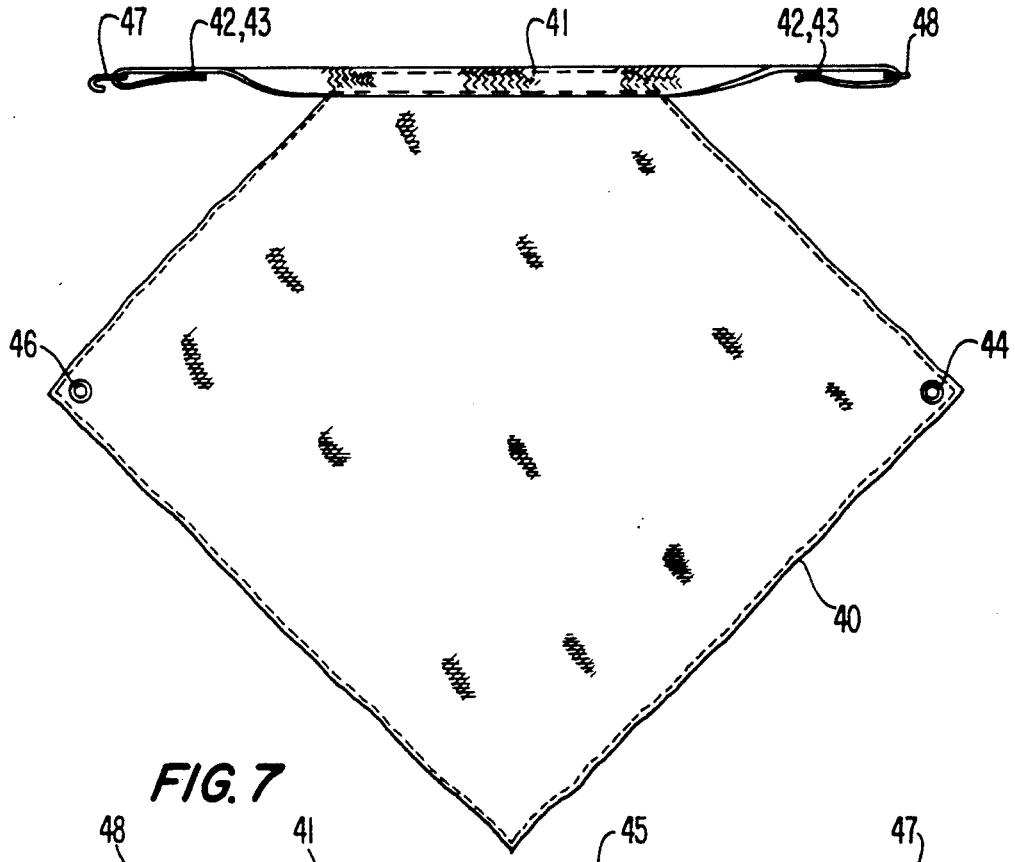
FIG. 6 is a top plan view of a third embodiment of the athletic headwear of the present invention.
Figure 11:
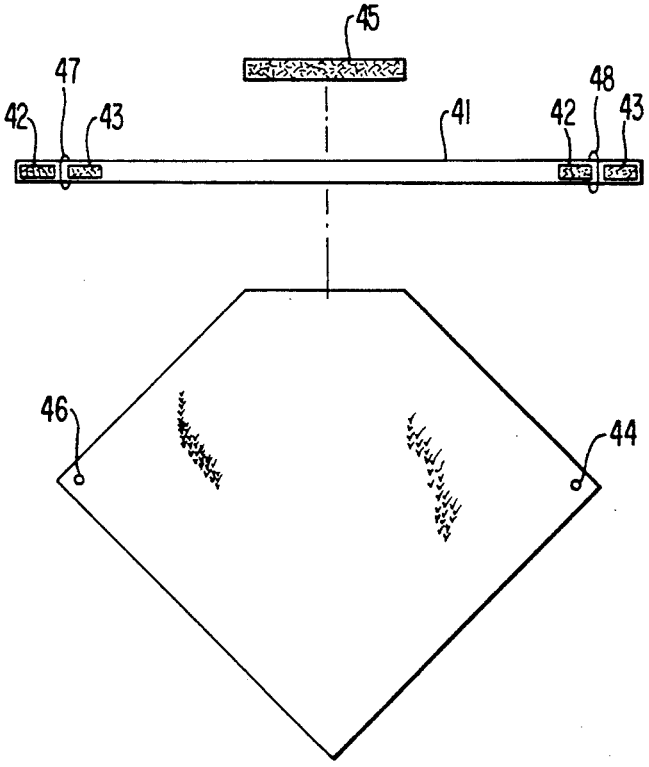
FIG. 11 is a top plan view of a single panel, headband and sweatpad for assembly into the third embodiment of the athletic headwear of the present invention.

FIG. 6 is a top view of a third embodiment of the headwear of the present invention showing the outer surface of the headwear when worn. The body portion 40 is generally configured in the shape of a pentagon and is assembled from the single panel of material shown in FIG. 11. The pentagonal shaped panel is easily prepared by removing a corner from a square piece of material. This embodiment is advantageous in being essentially a seamless pattern which requires no sewing or stitching except around the outer edges and to attach the sweatpad 45 and headband 41. The headband 41 is attached to the forward edge of the body portion 40. The fastening means shown are the hook and loop 47,48 and opposite configuration VELCRO pads 42 and 43. Also provided are means 44,46, for example snap means, for connecting the two corners of the body portion which are defined by the side and rear edges of the body portion. The connecting means 44,46 may be used to contain long hair in wind conditions. In this case, the snaps 44,46 may be secured under and around the hair of the wearer, allowing the hair to be encased in a tubular arrangement of the body portion. The snaps 44,46 may also be fastened in the back of the wearer's head upwardly and over the top of the body portion 40, which allows the back section of the body portion to have a pleated appearance.

Figure 7:
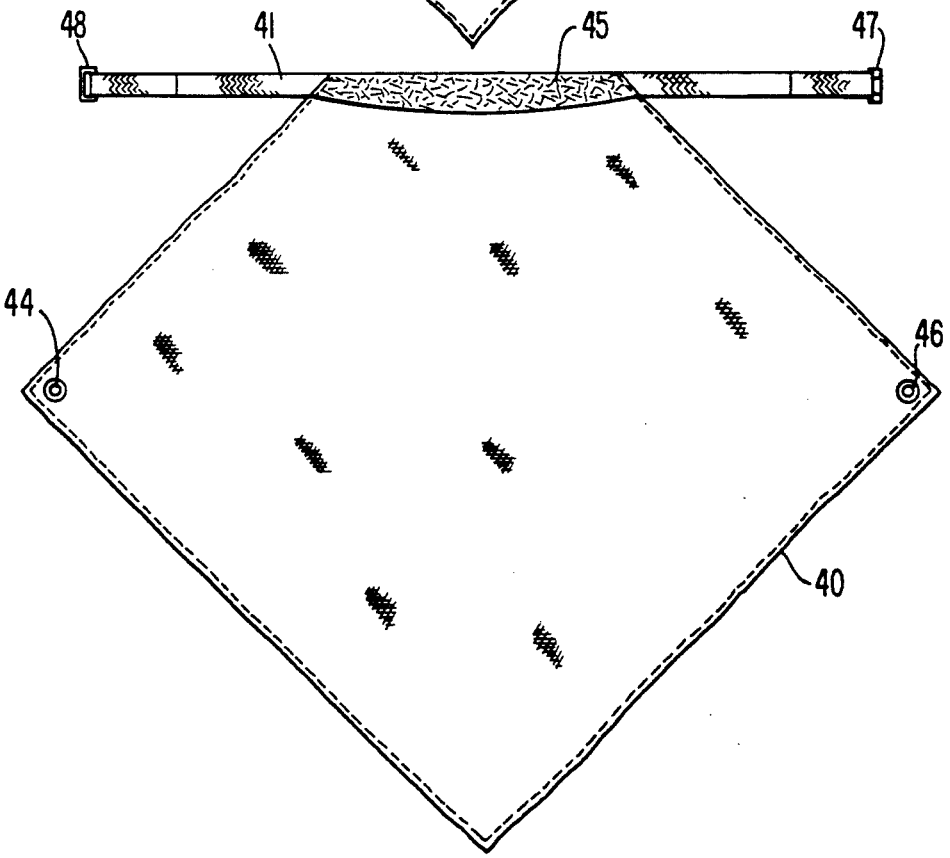
FIG. 7 is a bottom plan view thereof.

FIG. 7 is a bottom view of the third embodiment showing the inner or under surface of the headwear when worn. The sweatpad 45 is attached to the forward edge of the body portion 40.

I claim:

1. An article of headwear consisting essentially of:

a substantially rectangular body having inner and outer surfaces, generally linear elongated opposed side edges and generally linear opposed forward and rear edges defining forward and rear portions of said body, said forward portion being formed from a pair of arcuate shaped portions which are mirror images of each other, said arcuate portions being secured together along a common edge to form said linear forward edge of said body for fitting over the wearer's forehead and to form said forward portion of said body for fitting snugly over the wearer's head, said rear portion of said body being substantially planar for draping down the back of the wearer's head, an elastic headband integrally connected to said forward edge of said body on its outer surface, said elastic headband having opposite free ends extending beyond said forward edge, said opposite free ends having means for fastening to each other, so that said ends may be fastened to each other behind the head of the wearer over said body to secure the headwear to the wearer's head, and a sweatpad integrally connected to said forward edge of said body on its inner surface.

2. The headwear according to claim 1, wherein said body is formed from one panel of material.

3. The headwear according to claim 1, wherein said body is formed from two or more panels of material.

4. The headwear according to claim 1, wherein said body is comprised of at least one material selected from the group consisting of a natural fiber, a synthetic fiber, leather and a plastic.

5. The headwear according to claim 1, wherein said means for fastening said opposite free ends of said elastic headband together is adjustable.

6. The headwear according to claim 1, wherein said means for fastening said opposite free ends of said elastic headband together is a hook and loop type of device.

7. The headwear according to claim 1, wherein said means for fastening said opposite free ends of said elastic headband together utilizes VELCO.

8. The headwear according to claim 1, wherein said headwear further includes a visor.

9. An article of headwear consisting essentially of:

a substantially pentagonal body having inner and outer surfaces, a generally linear forward edge, two generally linear adjoining rear edges defining a corner of said pentagon disposed opposite said linear forward edge, and two generally linear side edges adjoining respective ends of said linear forward edge and said rear edges, said opposite adjoining side and rear edges defining opposite corners of said pentagon, said opposite corners having means for fastening to each other, said generally linear forward edge of said body adapted for fitting over the wearer's forehead, an elastic headband integrally connected to said forward edge of said body on its outer surface, said elastic headband having opposite free ends extending beyond said forward edge, said opposite free ends having means for fastening to each other, so that said ends may be fastened to each other behind the head of the wearer over said body to secure the headwear to the wearer's head, and a sweatpad integrally connected to said forward edge of said body of its inner surface.

10. The headwear according to claim 9, wherein said body is formed from one panel of material.

11. The headwear according to claim 9, wherein said body is comprised of at least one material selected from the group consisting of a natural fiber, a synthetic fiber, leather and a plastic.

12. The headwear according to claim 9, wherein said means for fastening said opposite free ends of said elastic headband together is adjustable.

13. The headwear according to claim 9, wherein said means for fastening said opposite free ends of said elastic headband together is a hook and loop type of device.

14. The headwear according to claim 9, wherein said means for fastening said opposite free ends of said elastic headband together utilizes VELCRO.

15. The headwear according to claim 9, wherein said headwear further includes a visor.

* * * * *